US009731256B2

(12) United States Patent
Dinnison

(10) Patent No.: US 9,731,256 B2
(45) Date of Patent: Aug. 15, 2017

(54) MIXING IMPELLER WITH LEADING EDGES MINIMIZING ACCUMULATIONS ON BLADES

(71) Applicant: Jay G. Dinnison, Seattle, WA (US)

(72) Inventor: Jay G. Dinnison, Seattle, WA (US)

( * ) Notice: Subject to any disclaimer, the term of this patent is extended or adjusted under 35 U.S.C. 154(b) by 297 days.

(21) Appl. No.: 13/964,711

(22) Filed: Aug. 12, 2013

(65) Prior Publication Data

US 2015/0044057 A1 Feb. 12, 2015

(51) Int. Cl.

*B01F 7/22* (2006.01)
*B01F 7/00* (2006.01)
*B01F 15/00* (2006.01)

(52) U.S. Cl.

CPC ..... *B01F 7/00366* (2013.01); *B01F 7/001* (2013.01); *B01F 7/00341* (2013.01); *B01F 7/22* (2013.01); *B01F 15/00922* (2013.01); *Y10T 29/49336* (2015.01)

(58) Field of Classification Search

CPC ..... B01F 7/00375; B01F 7/00366; B01F 7/00341; B01F 7/22; B01F 7/06; B01F 7/20

USPC ..... 366/270, 330.1–330.7; 416/237

See application file for complete search history.

(56) References Cited

U.S. PATENT DOCUMENTS 1,850,199 A 5/1930 Bryant
2,148,555 A * 2/1939 Hicks ..... B64C 11/16 416/202
3,030,083 A * 4/1962 Stiffler ..... B01F 7/00475 366/316
3,147,958 A * 9/1964 Stiffler ..... A47J 43/0722 241/98
3,542,343 A 11/1970 Stoelting
4,482,298 A 11/1984 Hannon et al.
4,519,715 A * 5/1985 Golobic ..... B01F 7/00341 366/343
4,571,090 A 2/1986 Weetman et al.
4,577,975 A 3/1986 McCrory et al.
4,721,394 A * 1/1988 Casto ..... B01F 7/00341 366/330.2
4,900,159 A 2/1990 Jamison
5,249,993 A 10/1993 Martin
(Continued)

FOREIGN PATENT DOCUMENTS

DE DE 2624991 C2 * 4/1985 ..... B01F 7/00341
EP 2926892 A1 * 10/2015

*Primary Examiner* — Charles Cooley
(74) *Attorney, Agent, or Firm* — Charles J. Rupnick Attorney at Law

(57) ABSTRACT

An impeller blade formed of a central base portion having a center axis. At least a pair of impeller blades is extended outwardly from the central base portion, with each impeller blade further including an extension. A leading edge is formed on each of the impeller blades, with each leading edge being defined by an outer periphery of the central base portion, and each leading edge having at least a portion that forms a continuous curve with a radius decreasing outwardly toward a radial tip of the corresponding impeller blade, wherein the continuous decreasing radius curve of each leading edge is formed by a portion of an ellipse centered on the center axis, a short axis of the ellipse being equal to a long axis thereof divided by approximately three and one-half. Each blade extension is projected from the corresponding impeller blade opposite of the leading edge.

18 Claims, 4 Drawing Sheets

(56) References Cited

U.S. PATENT DOCUMENTS

| | | | | |
|---|---|---|---|---|
| 5,316,443 | A * | 5/1994 | Smith | B01F 7/00275 366/270 |
| 5,934,877 | A | 8/1999 | Harman | |
| 6,702,552 | B1 | 3/2004 | Harman | |
| 7,473,025 | B1 * | 1/2009 | Howk | B01F 7/00341 29/889.7 |
| 7,806,661 | B2 | 10/2010 | Duffield | |
| 9,138,698 | B2 * | 9/2015 | Lilja | B01F 7/00341 |
| 9,248,420 | B2 * | 2/2016 | Rawlings | B01F 7/22 |
| 9,289,733 | B2 * | 3/2016 | Maxon | B01F 7/22 |
| 9,334,874 | B2 * | 5/2016 | Xia | B01F 7/00375 |
| 9,604,183 | B2 * | 3/2017 | Dinnison | B01F 7/00058 |
| 2014/0211585 | A1 * | 7/2014 | Maxon | B01F 7/22 366/279 |
| 2015/0044057 | A1 * | 2/2015 | Dinnison | B01F 7/00366 416/237 |
| 2015/0240832 | A1 * | 8/2015 | Xia | F04D 29/181 416/243 |

* cited by examiner

MIXING IMPELLER WITH LEADING EDGES MINIMIZING ACCUMULATIONS ON BLADES

FIELD OF THE INVENTION

The present invention relates generally to mixing impellers, and in particular to mixing impellers which are rotated by a motor-driven drive shaft for mixing a liquid material having various solid materials entrained therein that may tend to accumulate on a leading edge of the impeller.

BACKGROUND OF THE INVENTION

Mixing impellers are in wide use in industry. Examples of industrial mixing impellers include designs which have a central hub and two, three, four or more radially extending blade type structures. These blades may be flat, angled, and in some cases have a wing or propeller shape. Typically, the impellers extend radially outwardly from a motor-driven shaft and are submerged inside a material to be mixed. Oftentimes the impellers are in an at least partially liquid mix which is being confined in a vessel, which may be holding the material in a batch process or a continuous process.

In some mixing applications, an undesirable phenomenon occurs wherein various solid materials that are entrained in the liquid material being mixed will tend to accumulate on a leading edge of the impeller and form lumps, strings, or so-called "rags." One way to understand this phenomenon is to consider impellers used on boats, which will capture weeds that adhere to a leading edge of the boat propeller and impede its operational efficiency. Similarly, a ceiling fan often accumulates dust on its leading edge which will form into elongated filaments or streams.

A similar phenomenon occurs, particularly, for example, in the case of mixing impellers used for wastewater or sewage water treatment, wherein the material being mixed often has various types of crud, solid particulates, hair and other non-dissolving material. As the water is being treated, these materials may tend to adhere to the leading edge of existing impellers, which reduces the flow over the impeller type, and reduces the efficiency of the impeller and may cause overload, vibration and possible damage to the equipment.

In many industrial applications, the impellers are so-called "axial flow" in which the liquid in the region of the impeller is being pumped in the direction generally parallel to the axis of the drive shaft (perpendicular to the direction of the extensions of the blades). In other instances, the impellers may be the so-called "radial flow" type, in which the material is generally being urged radially outwardly away from the drive shaft in a direction parallel to the direction of the extensions of the blades. Some impellers have been known to utilize a circular base having paddles radially extending outwardly therefrom.

In view of the foregoing, it is desirable to have a "weedless" mixing impeller that can mitigate, at least to some extent, the effect of the development of "rags" or other collections adhering to the leading edge of the impeller, or to any edge of the impeller.

SUMMARY OF THE INVENTION

Some aspects of some embodiments of the invention provide a mixing impeller that can mitigate, at least to some extent, the effect of the development of "rags" or other collections adhering to the leading edge of the impeller, or to any edge of the impeller.

Accordingly, the present invention is an impeller blade formed of a central base portion having a center axis. At least a pair of impeller blades is extended outwardly from the central base portion. According to one aspect of the invention, a leading edge is formed on each of the impeller blades, with each leading edge being defined by an outer periphery of the central base portion. Each impeller blade includes an extension, with each extension projected from the corresponding impeller blade opposite of the leading edge.

According to another aspect of the invention, each leading edge is formed having at least a portion that forms a continuous curve with a radius decreasing outwardly toward a radial tip of the corresponding impeller blade, wherein the continuous decreasing radius curve of each leading edge is formed by a portion of an ellipse centered on the center axis. According to another aspect of the invention, a short axis of the ellipse is approximately equal to a long axis thereof divided by approximately three and one-half.

Other aspects of the invention are detailed herein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 4 and FIG. 5 illustrate a final assembly of the impeller of FIG. 1 having a mounting hub for mounting the impeller onto the drive shaft, wherein FIG. 4 is an end view, and FIG. 5 is a side view showing a cross-section of the mounting hub.

DETAILED DESCRIPTION OF PREFERRED EMBODIMENT

A detailed illustrative embodiment of the present mixing impeller device is disclosed herein. However, techniques, systems and operating structures in accordance with the present mixing impeller device may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present mixing impeller device. The following presents a detailed description of an illustrative embodiment of the present mixing impeller device.

In the Figures, like numerals indicate like elements.

Figure 1:
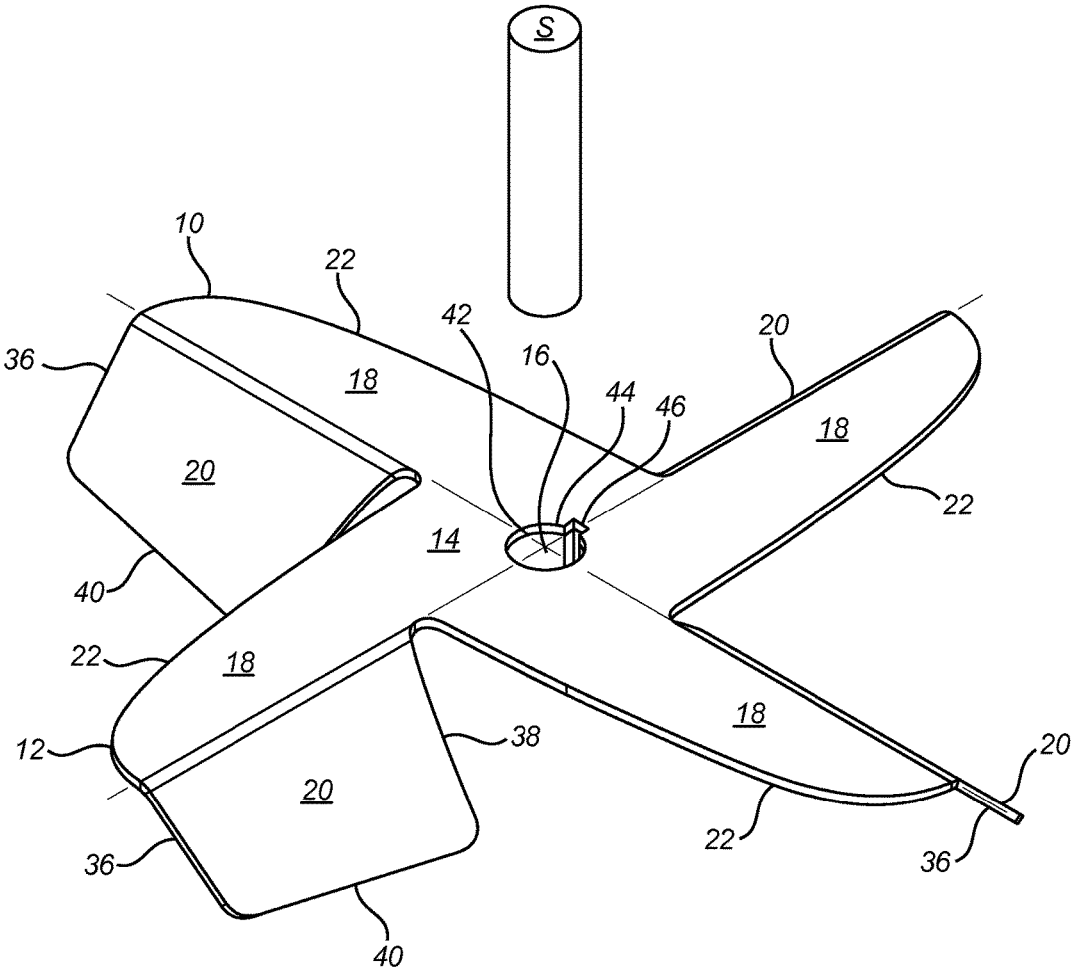
FIG. 1 is a perspective view showing an example of the mixing impeller of the invention for mounting on a drive shaft.

FIG. 1 illustrates an impeller 10 which can be mounted to a drive shaft S. Typically drive shaft S extends all the way through impeller 10, or impeller 10 can be mounted at the end of drive shaft S. Typically, drive shaft S extends inside a vessel (not shown) containing the material to be mixed, and is driven by a motor outside the vessel.

Figure 2:
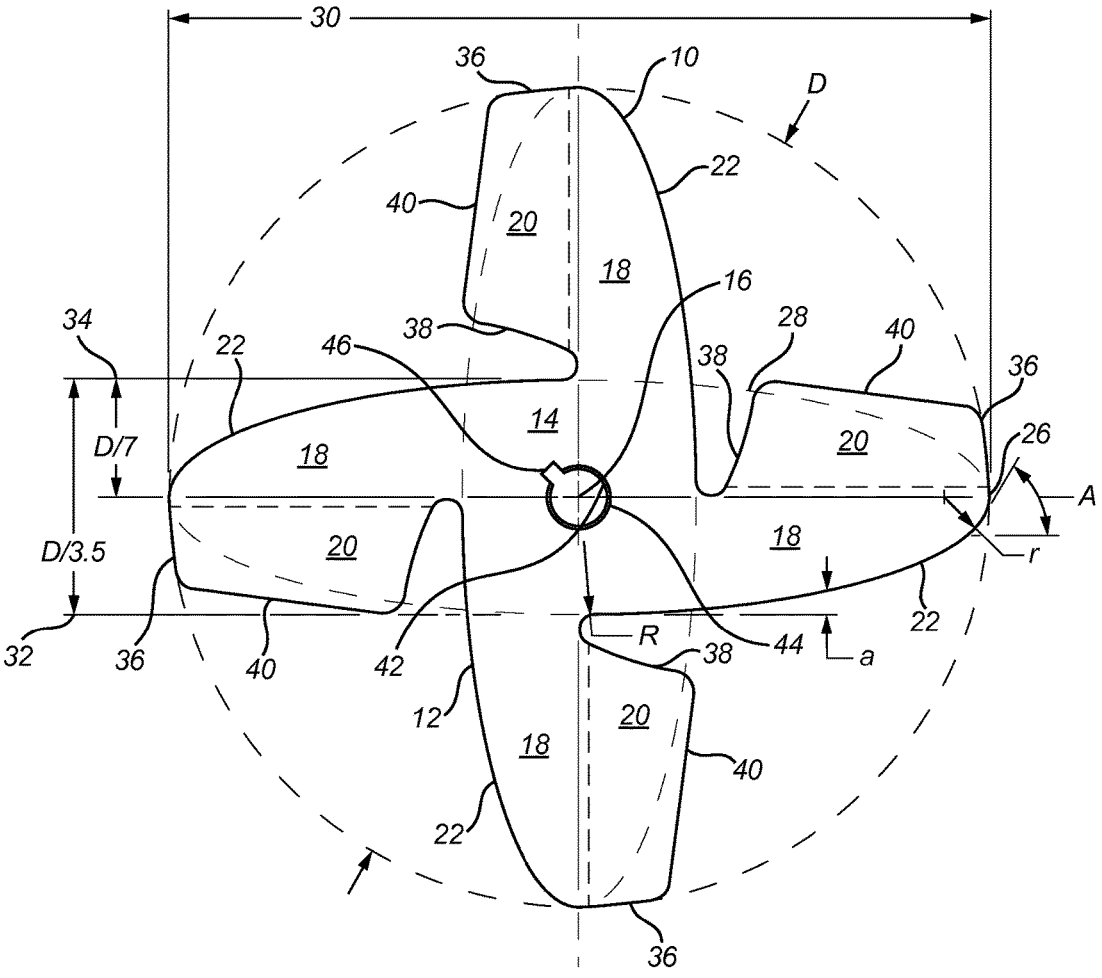
FIG. 2 is a plan view of a flat pattern of material for forming the impeller of FIG. 1.

FIG. 2 illustrates impeller 10 being formed as a plate 12 of a rigid flat sheet material that can be cut and bent. Of course, other manufacturing methods may be used for manufacturing impeller 10. Impeller 10 includes a central base portion 14 which is substantially a flat plate formed about a center axis 16. One or more impeller blades 18 are provided extended from central base portion 14 as shown. Here, impeller blades 18 are shown substantially coplanar with central base portion 14 of impeller 10. Additionally, impeller 10 is shown having four blade extensions 20, one extending from each impeller blade 18. Blade extensions 20 are bent away from central base portion 14 at a pitch angle, as shown.

Here, four impeller blades 18 are illustrated, each having a projecting extension 20; however, fewer or more, impeller blades 18 may be provided. Impeller blades 18 may be symmetrically disposed around center axis 16 of central base portion 14. As disclosed herein, impeller blade 10 is optionally of a unitary design. Such a design is convenient to form from a single flat plate which is cut to the desired outline shape, and impeller blade extensions 20 are bent by a suitable mechanical process.

However, in some cases, for example, in the case of large size impellers, it may be desirable to fabricate impeller 10 from a plurality of parts that are welded together or otherwise attached to each other. For example, individual blade extensions 20 are optionally welded on at an angle to corresponding impeller blade 18, and/or central base portion 14 itself and associated impeller blades 18 may be made of individual components each with an associated blade extension 20.

Alternatively, impeller 10 is optionally fabricated by welding together multiple plates. The plates may be configured so they are welded together end-to-end, thus creating a flat central base portion 14, or they may be fabricated to overlap each other and thus be stacked on each other. In such a case, central base portion 14 would have a greater thickness equal to the number of stacked plates. If the thickness of the plates is relatively thin overall, then it may be sufficient to have the thickness of central base portion 14 having steps formed where the plates overlap.

Central base portion 14 has a plurality of leading edges 22, with the number of leading edges 22 corresponding to the number of impeller blades 18. Each leading edge 22 extends from central base portion 14 at a transition location 24 of a next adjacent blade extension 20 outwardly to a radial tip 26 of corresponding impeller blade 18.

As illustrated here, each leading edge 22 has continuous instantaneous radius decreasing from a maximum instantaneous radius R as it extends from transition location 24 of one blade extension 20 to a minimum instantaneous radius r at radial tip 26 of corresponding impeller blade 18.

As disclosed here, leading edge 22 of each impeller blade 18 is formed as approximately one-quarter of an ellipse 28 having a long axis 30 equal to a diameter D of impeller 10 and a short axis 32 approximately equal to impeller diameter D divided by 3.5, expressed as D/3.5. Alternatively, the divisor by which the dividend (impeller diameter D) is divided is between about three (3) and four (4), whereby the relationship may be defined as D/3, or D/4 or another divisor between 3 and 4. Other suitable designs for leading edge 22 of impeller blade 18 that are defined by an outer periphery of central base portion 14 having at least a portion that forms a continuous curve having a radius decreasing outwardly toward radial tip 26 of corresponding impeller blade 18, regardless of either the specific divisor or the specific relationship between decreasing radius and diameter D of impeller 10, are also contemplated and may be substituted without deviating from the scope and intent of the present invention. Each leading edge 22 is centered on center axis 16 of central base portion 14, whereby each ellipse 28 is positioned having an offset 34 equal to one-half of ellipse short axis 32, expressed as D/7. Accordingly, leading edge 22 of each individual impeller blade 18 does not form a spiral as described in U.S. Pat. No. 7,473,025 of Richard Howk entitled "Mixing impeller with spiral leading edge," which is incorporated by reference herein in its entirety.

Rather, leading edge 22 forms a portion of a continuous elliptical shape with continuous instantaneous radius R, r decreasing outwardly from adjacent to center axis 16 toward radial tip 26 of corresponding impeller blade 18. A benefit of this continuous outwardly decreasing instantaneous radius R, r shape is an effectively "weedless" impeller 10 that operates in dirty products with leading edges 22 minimizing accumulation of "rags": weeds, hair, strings, solid particulates, and other non-dissolving matter, on blades 18.

The angle between leading edges 22 and the material being mixed, the "angle of attack," is a small angle adjacent to center axis 16 of central base portion 14, but continuously gradually increases to a larger angle toward radial tip 26 of corresponding impeller blade 18, such that leading edge 22 tends to be in shear with the material being mixed and tends not to collect "rags."

Impeller 10 is disclosed herein by example and without limitation as having a the angle of attack gradually increasing continuously along its length toward radial tip 26 of corresponding impeller blade 18 from a minimum angle of attack a as it extends from transition location 24 of one blade extension 20 to a maximum angle of attack A at radial tip 26 of corresponding impeller blade 18. However, in other embodiments, it may be only a portion of leading edge 22 that has this gradual change in angle of attack. In such instances, some parts of leading edge 22 may be simply arcuate (circular) around instantaneous radius R, r of leading edge 22. Also, the continuous elliptical arc described herein is alternatively composed of adjacent straight segments approximating the elliptical arc shape of ellipse 28.

Outer side edges 36 of individual blade extensions 20 projected from impeller blades 18 are substantially straight or slightly arcuate. Here, outer side edge 36 are illustrated as being an arcuate shape resulting from initial formation of impeller flat plate 12, and thus outer side edges 36 are geometric continuations of diameter D of impeller 10. Inner side edges 38 of individual blade extensions 20 are illustrated as a portion of ellipse 28 of leading edge 22. However, outer and inner side edges 36 and 38 can also have other shapes, and for example, individual blade extensions 20 rather than being a relatively rectangular flat extension, as illustrated, are alternatively triangular, trapezoidal, or another non-rectangular shape. Alternative shapes may be particularly advantageous where individual blade extensions 20 are separately formed from central base portion 14 and independently welded or otherwise joined onto impeller blades 18.

Figure 3:
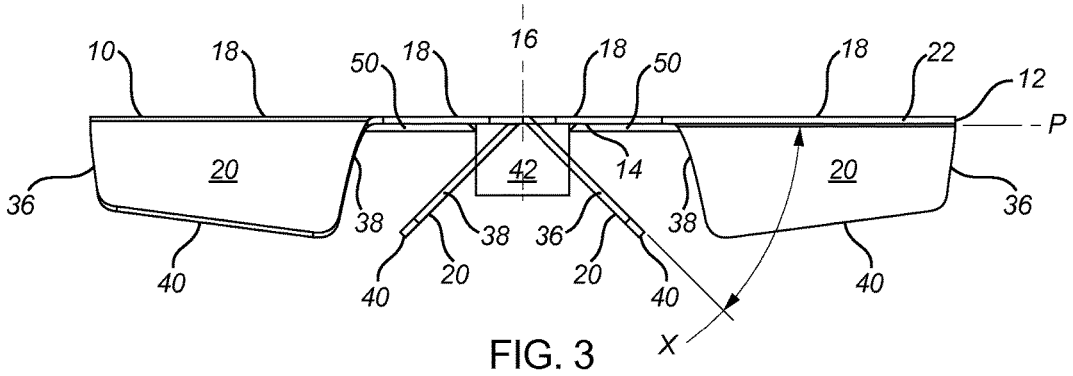
FIG. 3 is a side view of the impeller of FIG. 1 showing rotation of a plurality of blade extensions extending from individual impeller blades.

FIG. 3 illustrates individual blade extensions 20 of corresponding impeller blades 18 projected away from a plane P of central base portion 14 by a band pitch angle X of approximately 45 degrees. It will be appreciated that this band pitch angle X optionally varies anywhere from practically zero up to 90 degrees. It will be understood that a small band pitch angle X provides for generally axial flow pumping, while a larger band pitch angle X provides for more generally radial flow pumping.

FIG. 3 illustrates individual blade extensions 20 in the form of a substantially flat planar paddle. However, blade extension 20 can have any shape, and, rather than being planar, is optionally curved or be formed of multiple flat pieces at angles to each other. Further, trailing edges 40 of individual blade extensions 20 are illustrated as substantially linear edges. However, trailing edges 40 may be serrated, curved, castellated, or otherwise nonlinearly-shaped.

Figure 4:
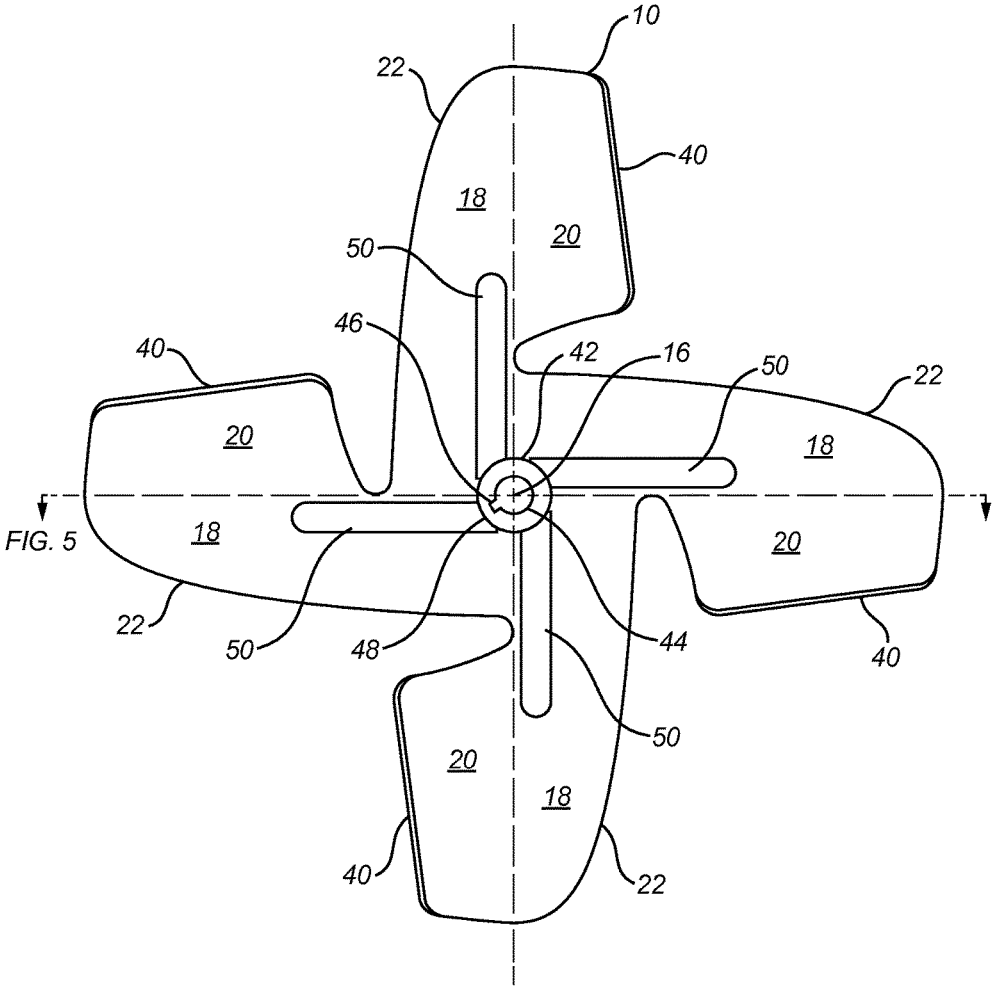
Figure 5:
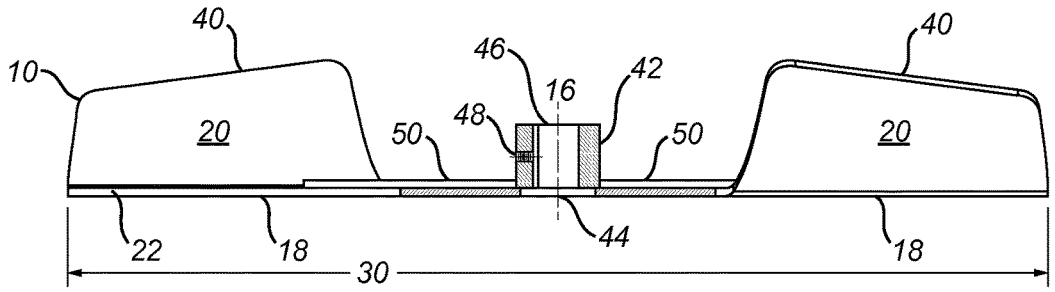

FIG. 4 and FIG. 5 illustrate a final assembly of impeller 10 which can be mounted to drive shaft S via a mounting hub 42. Typically drive shaft S extends all the way through hub 42, or hub 42 can be mounted at the end of drive shaft S.

As disclosed herein, impeller 10 includes a central aperture 44 along center axis 16 through central base portion 14, through which drive shaft S can pass. Hub 42 is aligned with central aperture 44. Hub 42 is affixed onto central base portion 14, both axially and rotationally, by any of many suitable attachment methods. For example, hub 42 is optionally welded or bolted to central base portion 14. Alternatively, hub 42 is optionally formed integrally with central base portion 14 of impeller 10. Here, hub 42 includes an optional keyway 46 mateable with a mating key (not shown) on drive shaft S. Hub 42 may include a threaded aperture 48 for receiving a set screw (not shown) for interlocking the key between drive shaft S and keyway 46 of impeller hub 42. Other suitable designs for hub 42, as well as attachment methods suitable for both axially and rotationally affixing hub 42 onto central base portion 14, are also contemplated and may be included and/or substituted without deviating from the scope and intent of the present invention.

According to one embodiment, strong backs 50 are affixed, as by bolting or welding, to individual impeller blades 18 for assuring rigidity of impeller 10.

An advantage of the embodiment disclosed herein is simplicity and ease of manufacture. Flat sheet material may be cut, and then blade extensions 20 bent from plane P of central base portion 14. Of course, other manufacturing methods may be utilized, and as discussed above, entire impeller 10 can be integral, or formed of a plurality of individual components which are attached together.

An advantage of the disclosed manufacturing method is that a single set of flat impeller blanks 12 can be cut out, and then different ones can have each of their blade extensions 20 bent to different pitch angles X, permitting easy, test, adjustment, or adaptation of impellers 10. Different power factors or performance are possible from the same blank 12 simply by varying the pitch angle X at which blade extensions 20 are bent.

In this disclosure, the word "impeller" is used to refer to the entire structure of impeller 10, which includes central base portion 14 that forms leading edges 22, as well as blade extensions 20. Of course, individual blade extensions 20 may be considered as blades, and are also referred to as flow inducer portions. The selection of the term "impeller" to describe the entire structure of impeller 10, the use of the term "blade" to describe individual extensions 18, and the use of "extension" to describe components 20 angled from plane P is for convenience and not intended to limit the scope of the description in any way. Also, the term "blade" 18 refers to the flat structure that comprises leading edges 22, or to the structure other than blade extensions 20.

While the preferred and additional alternative embodiments of the invention have been illustrated and described, it will be appreciated that various changes can be made therein without departing from the spirit and scope of the invention. Therefore, it will be appreciated that various changes can be made therein without departing from the spirit and scope of the invention. Accordingly, the inventor makes the following claims.

What is claimed is:

1. An impeller blade, comprising:

a central base portion having a center axis;

at least a p air of impeller blades extending outwardly from the central base portion, each impeller blade comprising an extension;

a leading edge formed on each of the impeller blades, each leading edge defined by an outer periphery of the central base portion, each leading edge forming a continuous curve that is defined as approximately one quarter of an ellipse having a radius that decreases outwardly from the central base portion toward a radial tip of the corresponding impeller blade, and wherein the approximately one quarter of an ellipse of each leading edge further comprises a short axis equal to a long axis thereof divided by between approximately three and four; and each extension being projected from the corresponding impeller blade opposite of the leading edge.

2. The impeller blade of claim 1, wherein each leading edge extends from an adjacent blade extension outwardly to the radial tip of the corresponding impeller blade.

3. The impeller blade of claim 1, wherein each of the impeller blades lie substantially in a plane with the central base portion.

4. The impeller blade of claim 1, wherein each blade extension projects at an angle away from the plane of the central base portion.

5. The impeller blade of claim 1, further comprising a hub mounted to the central base portion and aligned with the center axis.

6. The impeller blade of claim 1, wherein the decreasing radius of the continuous curve of each leading edge further comprises a continuously decreasing instantaneous radius that decreases from a maximum instantaneous radius adjacent to the central base portion to a minimum instantaneous radius adjacent to the radial tip of the corresponding impeller blade.

7. The impeller of blade claim 6, wherein the approximately one quarter of an ellipse defined by the continuous decreasing radius curve of each leading edge is further substantially centered on the center axis.

8. The impeller of blade claim 7, wherein the approximately one quarter of an ellipse of each leading edge further comprises a short axis equal to a long axis thereof divided by approximately three and one-half.

9. The impeller blade of claim 1, wherein the leading edge of each impeller blade further comprises an angle of attack that increases continuously along its length from a minimum angle of attack adjacent to the from the central base portion toward a maximum angle of attack adjacent to the radial tip thereof.

10. An impeller blade, comprising:

a central base portion having a center axis;

at least a pair of means for inducing flow, the pair of means extending symmetrically away from the central base portion;

at least two leading edges defined by an outer periphery of the central base portion, each leading edge forming a portion of a continuous elliptical shape spanning from one of the means for inducing flow to an adjacent one of the means for inducing flow, and each leading edge having a continuous instantaneous radius thereof that decreases from adjacent to the center axis to form a continuous curve that is defined as approximately one quarter of a noncircular ellipse having a center substantially coincident with the center axis and having an instantaneous radius that is decreasing outwardly away from the center axis toward a maximum extent of the corresponding means for inducing flow.

11. The impeller blade of claim 10, wherein each leading edge substantially lies in a plane with the central base portion.

12. The impeller blade of claim 11, wherein each of the means for inducing flow extends away from the plane of the central base portion at an angle.

13. The impeller blade of claim 11, further comprising a hub mounted to the central base portion and aligned with the center axis.

14. The impeller blade of claim 10, wherein the ellipse defined by the outer periphery of the central base portion further comprises an ellipse having a short axis equal to a long axis thereof divided by approximately three and one-half.

15. A method for forming an impeller, the method comprising:

about a center axis, forming at least a pair of impeller blades;

forming extensions extending from the impeller blades; and on each of the impeller blades, shaping a leading edge defined by an outer periphery thereof between one blade extension to an adjacent blade extension, and each leading edge forming a continuous elliptical shaped curve having a continuous instantaneous radius decreasing outwardly from the center axis of the central base portion and is defined as approximately one quarter of a noncircular ellipse, and wherein the approximately one quarter of a noncircular ellipse defined by the leading edge of each of the impeller blades further comprises a short axis equal to a long axis thereof divided by between approximately three and four.

16. The method according to claim 15, wherein the continuous curve of each leading edge further comprises a continuous instantaneous radius that decreases from a maximum instantaneous radius adjacent to the center axis to a minimum instantaneous radius spaced away from the center axis.

17. The method according to claim 16, wherein the approximately one quarter of an ellipse defined by the leading edge of each of the impeller blades is further centered on the center axis.

18. The method according to claim 15, wherein the approximately one quarter of an ellipse defined by the leading edge of each of the impeller blades further comprises a short axis equal to a long axis thereof divided by approximately three and one-half.

* * * * *